US008528306B2

(12) United States Patent
Elsaesser et al.

(10) Patent No.: US 8,528,306 B2
(45) Date of Patent: Sep. 10, 2013

(54) METHOD AND DEVICE FOR PRODUCING POCKETS PROVIDED WITH NAPKINS

(75) Inventors: Robert Elsaesser, Burgdorf (CH); Remy Bendele, Soultzbach Bains (FR)

(73) Assignee: ELAG ast GmbH, Kirchberg (CH)

( * ) Notice: Subject to any disclaimer, the term of this patent is extended or adjusted under 35 U.S.C. 154(b) by 576 days.

(21) Appl. No.: 12/733,626

(22) PCT Filed: Sep. 26, 2008

(86) PCT No.: PCT/EP2008/008197

§ 371 (c)(1),
(2), (4) Date: Mar. 11, 2010

(87) PCT Pub. No.: WO2009/043542

PCT Pub. Date: Apr. 9, 2009

(65) Prior Publication Data

US 2010/0212266 A1 Aug. 26, 2010

(30) Foreign Application Priority Data

Sep. 26, 2007 (AT) ..... 1521/2007

(51) Int. Cl.

| | |
|---|---|
| ***B65B 9/06*** | (2012.01) |
| ***B65B 11/50*** | (2006.01) |
| ***A47G 11/00*** | (2006.01) |
| ***A47G 21/00*** | (2006.01) |

(52) U.S. Cl.
USPC ..... 53/459; 53/568

(58) Field of Classification Search
CPC ..... B65B 11/50; B65B 25/143; B65B 9/073; B65B 9/06; A47G 23/0303; A47G 11/00; A47G 21/16; A47G 21/00
USPC ..... 53/450, 455, 562, 558, 251, 252, 53/255, 263, 459, 460, 545, 548, 550, 568, 53/569, 284.2; 206/553
IPC ..... B65B 11/50, 9/06; A47G 11/00, 21/16, A47G 21/00
See application file for complete search history.

(56) References Cited

U.S. PATENT DOCUMENTS 3,195,289 A * 7/1965 Cochrane ..... 53/568
3,330,090 A * 7/1967 Court et al. ..... 53/450

(Continued)

FOREIGN PATENT DOCUMENTS

DE 4338498 A1 * 5/1995
EP 0 034 568 8/1981

(Continued)

OTHER PUBLICATIONS

International Search Report, PCT/EP2008/008197, mailed Dec. 9, 2008, 2 pages.

*Primary Examiner* — Stephen F Gerrity
(74) *Attorney, Agent, or Firm* — Collard & Roe, P.C.

(57) ABSTRACT

The invention relates to a method of producing pockets containing a napkin (5). To this end, two web-shaped layers (1, 2) of a flat, flexible material are moved along a transport path and held at a distance apart from one another in one section of the transport path. Napkins (5) are individually picked up from a stack and placed between the layers (1, 2). Only then, downstream of the section in the web direction, are adjacent regions of the layers (1, 2) placed in contact with one another and joined to one another. The pockets formed in this manner are cut from the web-shaped layers (1, 2). In the section, a respective napkin (5) is moved in a direction essentially at a right angle to the web direction and placed between the layers (1, 2) in a position oriented essentially parallel with the web direction.

17 Claims, 3 Drawing Sheets

(56) References Cited

U.S. PATENT DOCUMENTS

| | | | | | |
|---|---|---|---|---|---|
| 3,339,337 | A | * | 9/1967 | Rapp et al. | 53/562 |
| 3,376,974 | A | | 4/1968 | Hilliard | |
| 3,429,718 | A | * | 2/1969 | Helms | 426/122 |
| 4,177,846 | A | * | 12/1979 | Rountree | 108/90 |
| 4,205,504 | A | * | 6/1980 | Gregoire et al. | 53/562 |
| 4,449,351 | A | * | 5/1984 | Henderson | 53/569 |
| 4,663,915 | A | * | 5/1987 | Van Erden et al. | 53/450 |
| 5,022,216 | A | * | 6/1991 | Muckenfuhs et al. | 53/438 |
| 5,058,364 | A | * | 10/1991 | Seiden et al. | 53/455 |
| 5,266,140 | A | * | 11/1993 | Kohno | 53/455 |
| 5,335,478 | A | * | 8/1994 | Aronsen | 53/412 |
| 5,803,256 | A | * | 9/1998 | Lydhig et al. | 206/440 |
| 5,829,230 | A | * | 11/1998 | Hartz | 53/455 |
| 5,873,219 | A | * | 2/1999 | Storti | 53/568 |
| 2003/0121236 | A1 | * | 7/2003 | Middelberg et al. | 53/460 |
| 2006/0048484 | A1 | * | 3/2006 | Wasson et al. | 53/450 |

FOREIGN PATENT DOCUMENTS

| | | | | |
|---|---|---|---|---|
| EP | 858951 | A1 | * | 8/1998 |
| JP | 05310282 | A | * | 11/1993 |
| JP | 06199381 | A | * | 7/1994 |
| JP | 10155626 | A | * | 6/1998 |
| JP | 10-316108 | | | 12/1998 |
| JP | 2001328183 | A | * | 11/2001 |
| JP | 2006282194 | A | * | 10/2006 |
| WO | WO 9421529 | A2 | * | 9/1994 |
| WO | WO 99/23984 | | | 5/1999 |

* cited by examiner

METHOD AND DEVICE FOR PRODUCING POCKETS PROVIDED WITH NAPKINS

CROSS REFERENCE TO RELATED APPLICATIONS

This application is the National Stage of PCT/EP2008/008197 filed on Sep. 26, 2008, which claims priority under 35 U.S.C. §119 of Austrian Application No. A 1521/2007 filed on Sep. 26, 2007. The international application under PCT article 21(2) was not published in English.

The invention relates to a method of producing pockets containing a napkin, whereby two web-shaped layers of a flat, flexible material are moved along a transport path and held at a distance apart from one another in one section of the transport path, napkins are separated from a stack and placed between the layers, regions of the layers adjacent to the napkins are placed in contact with one another and joined to one another downstream of the section in the web direction, and the resultant pockets are then cut from the web-shaped layers.

In this context, the term napkins should be construed as meaning absorbent, flat, flexible objects, including those with a low degree of stiffness, in particular folded and/or multi-layered objects made from a fibrous and/or textile material. The term pocket in this context should be construed as meaning a flat envelope which is open in the region of at least one side edge.

Pockets containing napkins are becoming increasingly popular. They enable tables to be set more rapidly and easily in the catering industry and the napkins do not have to be touched by the staff. In many instances, the pockets are often additionally filled with cutlery, which further simplifies the task of setting tables. Especially outdoors, for example in the garden or on terraces of catering establishments, pockets offer an additional advantage in that the napkins can not be blown away from the table by the wind. Moreover, the pockets can be decorated with decorative elements and/or colours and/or advertising.

A known approach is to produce the pockets first of all and then fill each one with a napkin. This approach to the filling operation is quite complex because each pocket has to be individually gripped, its opening prised open, and a napkin inserted in it, usually by gravitational force. As a result of this work-intensive filling process, the end product is relatively expensive and thus loses some of its attraction.

Document WO 1999/23984 A1 describes individually packaged absorbent articles and a method of producing them. The absorbent articles, which might be liners for underwear for example, are completely enclosed by the packaging material. During the production process, a web of packaging material is continuously folded at both of its longitudinal edges in order to form two layers, the articles are moved in the web direction and placed between the layers, and the layers are then joined to one another so that the articles are completely enclosed by the packaging material. Individual packaged units are then cut from the web.

Patent application EP 0 034 568 A1 discloses a method and a device for detachably joining a paper napkin to a paper place setting, whereby a napkin is inserted between tabs punched in the place setting set beforehand.

The underlying objective of the invention is to propose a method whereby pockets can be filled with napkins easily and inexpensively in large numbers and the napkins are positioned exactly between the layers.

This objective is achieved by the invention due to the fact that in the section in question, a napkin is respectively moved between the layers into a position oriented essentially parallel with the web direction by a movement in a direction essentially at a right angle to the web direction.

The particular advantage of this solution is that pockets can be filled with napkins much more easily and quickly and hence more inexpensively than is the case with known methods and in particular, the napkins are exactly positioned between the layers.

In the case of one embodiment, the two web-shaped layers are formed by folding a single web of the flat, flexible material in the direction of the web. This offers advantages in terms of handling because only one web has to be moved. This also saves on a joining seam at the base of the pockets.

In another embodiment, the longitudinal edge of one layer at the end from which the napkin is placed between the layers is set back from the longitudinal edge of the other layer. This offers the possibility of leaving the napkin protruding out from the opening of the pocket without protruding out from the pocket itself. The guest will later see the napkin immediately and will be able to remove it more easily.

In one embodiment, the longitudinal edge of the other layer is folded and the folded part extends underneath the longitudinal edge of the one layer. This means that if using a web printed on one side, the result will be a pocket printed on all sides because the non-printed side will be completely hidden in the interior of the pocket.

Yet another embodiment is distinctive because the longitudinal edge of the one layer has a contour. By contour is meant that the longitudinal edge does not run in a straight line. By preference, the contour is oriented towards the region of a napkin in each case so that the napkin is even more readily visible and can be removed even more easily.

In the case of another embodiment, cuts are provided in the one layer at a distance from its longitudinal edge. In the finished pocket, these can be used for inserting implements, in particular cutlery, which then lies on the napkin and is readily visible.

In another embodiment, the flat, flexible material is a foil or paper, which is preferably provided with a sealable layer in at least one region. Such a layer may be made from polyethylene for example, enabling the layers to be joined by heat sealing.

In another embodiment, the napkins in the stack are oriented at least approximately parallel with at least one of the two web-shaped layers. This enables them to be placed on the ram described below in one movement parallel with their plane.

As an alternative to the embodiment mentioned above, the napkins in the stack are oriented at least approximately at a right angle to at least one of the two web-shaped layers. This offers the possibility of moving the napkins onto the ram described below by means of a pivotable separating element.

In one embodiment of the method, the napkins are separated from the stack by a moving separating element which is placed under vacuum. A separation process using a vacuum is particularly suitable for napkins which have little resistance to bending.

In one particular embodiment, the separating element can be pivoted about approximately 90 degrees. A pivotable separating element is particularly practical from a mechanical point of view and offers a simple way of depositing on the ram described below.

In the case of yet another embodiment, a napkin is deposited by the separating element on a ram which moves backwards and forwards in a reciprocating movement and places the napkin between the layers. Since napkins generally have little resistance to bending, such a ram ensures problem-free operation.

In the case of another embodiment, a cut-out is provided in the ram and the separating element moves through it as it deposits the napkin, and the separating element is constantly kept under vacuum so that the napkins are correctly positioned without the vacuum having to be controlled by valves or such like.

Finally, in another embodiment of the method, at least one empty pocket is formed adjacent to each pocket filled with a napkin in the web direction and a group of pockets is respectively cut from the web-shaped layers. This enables pocket combinations to be produced which can be used for a number of purposes and are particularly useful for holding place settings.

The invention also relates to a device for producing pockets filled with a napkin, comprising means for conveying two web-shaped layers of a flat, flexible material in the web direction along a transport path, a spacer in order to hold the layers at a distance apart from one another in one region of the transport path, a napkin holder in which the napkins are stored in a stack, a separating device for separating the napkins from the stack, inserting means for inserting a napkin respectively between the layers, means for placing the layers in contact and joining certain regions of them to form pockets and means for cutting the pockets from the web-shaped layers, the means for placing the layers in contact and joining certain regions of them being disposed downstream of the inserting means in the web direction.

The objective of this aspect of the invention is to propose a device by means of which pockets filled with a napkin can be easily, automatically and inexpensively produced on a mass scale and the napkins positioned exactly between the layers.

This objective is achieved due to the fact that the inserting means has a support oriented essentially parallel with the web direction and disposed in a position essentially at a right angle to the web direction and can be moved in a reciprocating motion between a position in which the support is disposed next to the layers and a position in which the support is disposed at least partially between the layers.

This solution offers a major advantage in that it obviates the need to grip or take hold of finished pockets and prise their opening apart in order to insert a napkin and in particular, the napkins are exactly positioned between the layers.

The invention will be explained in more detail below with reference to examples of embodiments illustrated in the appended drawings.

Of these:

Figure 1:
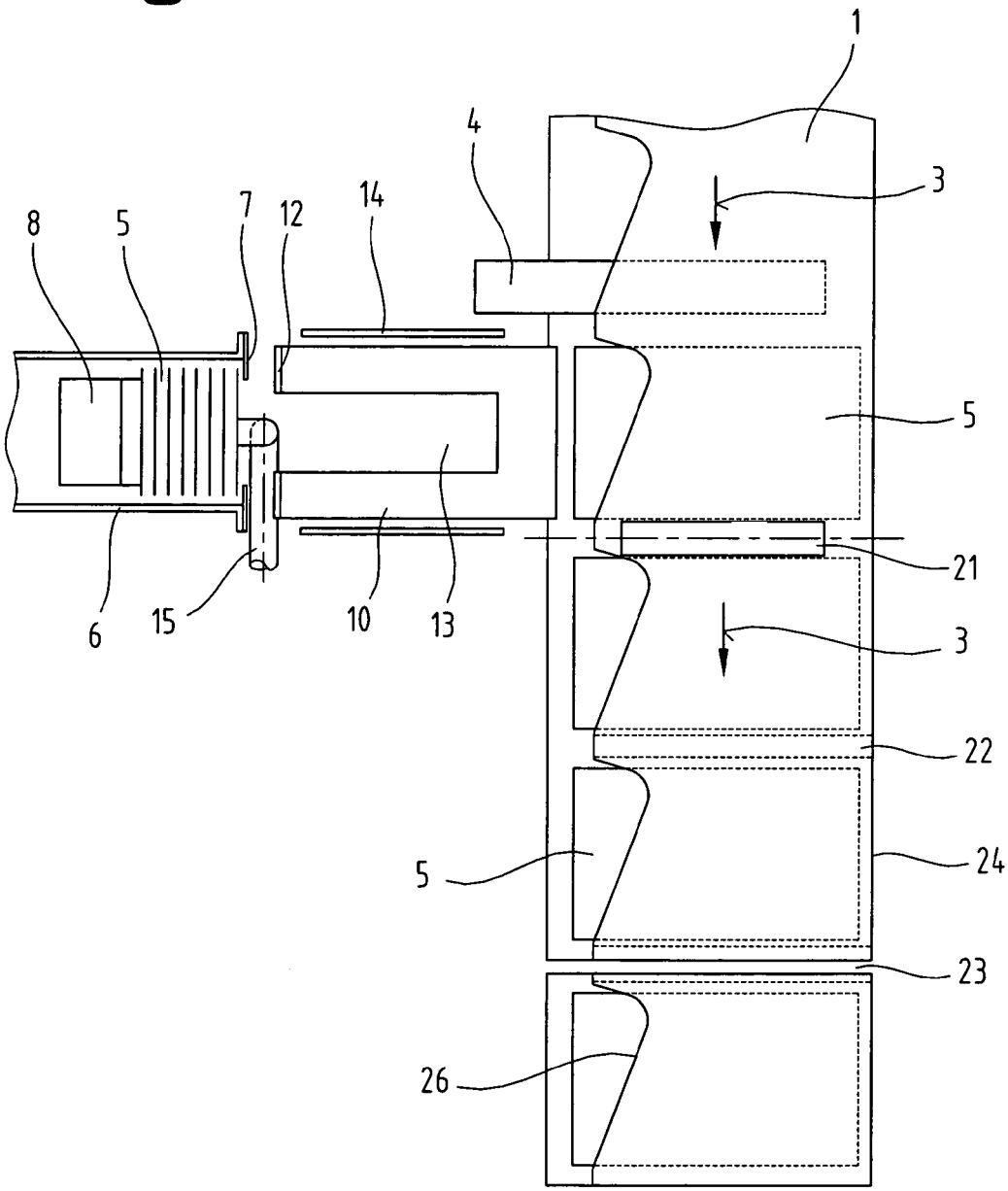
FIG. 1 is a schematic diagram showing a plan view of a plant for implementing the method proposed by the invention.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

Figure 2:
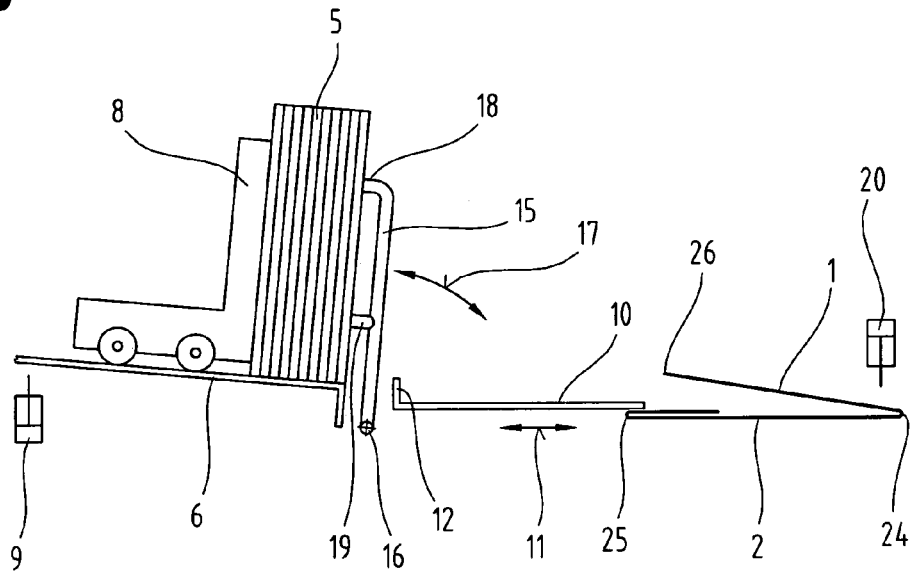
FIG. 2 is a schematic view in elevation of the plant illustrated in FIG. 1.

FIGS. 1 and 2 provide a schematic illustration of an example of some of the components of a plant used to implement the method proposed by the invention for producing pockets filled with a napkin and the materials used, as well as an example of an end product. In the example illustrated, a paper web, printed on one side for example, is stored on a roll, although this is not illustrated, drawn from the roll and folded lengthways to form two web-shaped layers 1 and 2. However, the two layers 1 and 2 may also be separate paper webs. Arrows 3 in FIG. 1 denote the transport path of the layers 1, 2. The layers 1, 2 are fed essentially horizontally and are preferably transported on an intermittent basis. A spacer 4, which in this instance is wedge-shaped, is disposed in a stationary arrangement between the layers 1, 2 and ensures that the layers 1, 2 are held at a distance apart from one another in one section of the transport path. Folded napkins 5 are held in a stack in a napkin holder 6 so that the plane of the napkins is essentially vertically oriented approximately at a right angle to the plane of the layers 1, 2 and the longitudinal axis of the napkins. Retaining plates 7 on the napkin holder 6 prevent the napkins 5 from falling out of the holder 6. A pressing device 8 ensures that the napkin stack always lies against the retaining plates 7. The pressing device 8 is preferably mounted on rollers and the base of the napkin holder 6 is slightly inclined towards the layers 1, 2. If the intrinsic weight of the pressing device 8 is not sufficient to push the napkins 5 forward, a knocking mechanism 9 may be provided underneath the napkin holder 6 to shake the napkin holder 6, which is illustrated in FIG. 2 in the form of a stylised piston-cylinder unit. With this arrangement of the napkin holder 6, care should be taken to ensure that the folded edge of the napkins 5 lies at the top in the holder.

Disposed between the napkin holder 6 and the layers 1, 2 is a ram 10, which is able to move backwards and forwards from the initial position illustrated in the drawings in the direction of double arrow 11 between the layers 1, 2. In order to guide each napkin 5 as it arrives at the ram 10 in a manner that will be described below, an arm 12 projects vertically out from the ram 10 on the side of the ram 10 remote from the layers 1, 2 and stationary lateral guides are provided on either side of the ram 10.

In order to separate the napkins 5 and deposit a napkin 5 on the ram 10, a suction pipe 15 is provided, which can be pivoted about a pivot axis 16 disposed parallel with the transport direction of the layers 1, 2 and is able to pivot backwards and forwards by approximately 90 degrees in the direction of double arrow 17. The suction pipe 15, which is placed under vacuum, has two suction orifices 18 and 19, by means of which the foremost napkin 5 of the stack is sucked up and deposited on the ram 10 after the suction pipe 15 has effected a pivoting movement. During this pivoting movement, the suction pipe 15 dips through a slot 13 provided in the ram 10 for this purpose, and the path of the suction pipe 15 is dimensioned so that the suction orifices 18 and 19 are moved back by a distance from the napkin 5 after depositing the napkin 5 on the ram 10. This obviates the need for a control device and a valve for controlling the vacuum at the suction pipe 15.

Once deposited on the ram 10, the napkin 5 is moved between the layers 1 and 2 by said movement of the ram 10 in the direction of double arrow 11, where it is left as the ram 10 is retracted. If using a folded web, the space between the layers 1, 2 is wedge-shaped so that the napkin 5 is lightly clamped in the region of the base edge 24 and the napkin 5 is therefore not pulled back out again as the ram moves back. If the clamping force of the actual layers 1, 2 is not sufficient, which may be the case in particular if using two separate layers 1, 2, it is possible to provide a clamping device to secure the napkin 5, which is illustrated in FIG. 2 in the form of a stylised piston-cylinder unit 20.

As the napkin 5 is being inserted, the layers 1, 2 are preferably held. To prevent the napkin 5 disposed precisely between the layers 1, 2 from slipping as the latter are fed onwards in a stepped movement, the following features may be provided. A pressing roller 21 which can be moved perpendicular to the layers 1, 2 can press the layers together during the subsequent transport step, thereby holding the napkins 5 firmly between the layers 1, 2. Instead of the pressing roller 21, it would also be possible to provide a sealing device which at least temporarily joins the layers 1, 2 between two napkins 5. As a rule, however, this feature can be dispensed with, especially if using a folded web and if the layers 1, 2 are not accelerated to too great a degree during their onward transport.

At the opening end of the pocket, the two layers 1, 2 are advantageously offset from one another so that the napkin 5 always remains visible and can be easily removed in readiness for use. In addition, the opening edge 26 bordering the top layer 1 may have an arch-shaped contour, for example, as illustrated in FIG. 1. Since the paper web used to make the pockets is advantageously printed on one side, the web is provided with a fold 25 at the opening end in the embodiment illustrated as an example in FIG. 2 so that the free end of the folded arm is overlapped by the top layer 1 when the pocket is finished. This is also of particular advantage if a paper coated with polyethylene is used, for example, because the coated side can be welded but is difficult to print on.

Once the napkin 5 has been inserted, the layers 1, 2 are moved towards one another and joined to one another in the region between two consecutive napkins 5 respectively. Known thermal sealing processes are preferably used for this purpose. Since these sealing methods and the devices used to implement them do not fall within the subject matter of this patent application, the relevant region is merely indicated in FIG. 1 in the form of the seal region 22. The seal region 22 is wide enough to enable a strip to be cut out from the layers during the subsequent cutting process whilst leaving a sealed edge behind at the side edges of the resultant pocket. The cutting of a strip is indicated by the cutting region 23 in FIG. 1, which is the preferred region because when printing the web using a rotary press method, it is not necessary to make use of the entire circumference of the printing cylinder and the non-printed material can be cut from the web.

Figure 3:
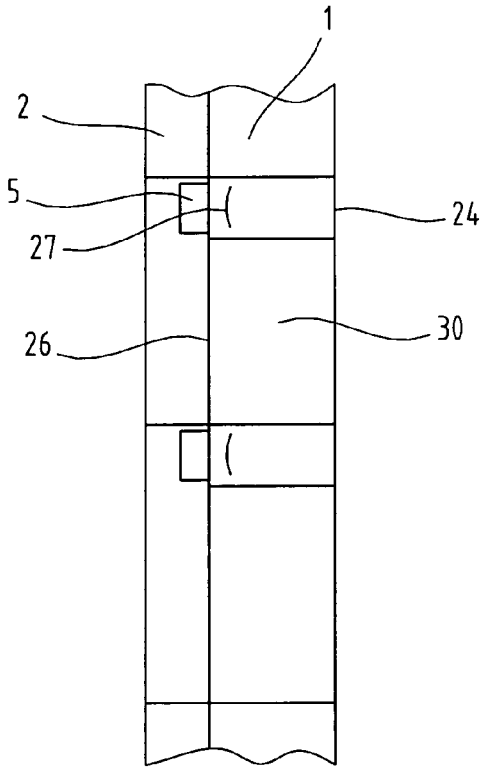
FIG. 3 illustrates how a table place is produced.

The method proposed by the invention may not only be used to produce pockets of the type illustrated at the bottom of FIG. 1. Instead, it is also possible to produce multiple pockets with pockets lying adjacent to one another, which may be used as a place setting for example, as described below with reference to FIGS. 3 and 4. The diagram of FIG. 3 provides a schematic illustration of how place settings are produced, the same reference numbers being used to denote parts that are the same as those described in connection with the embodiment illustrated in FIGS. 1 and 2. FIG. 3 shows the web-shaped top layer 1 and the bottom layer 2 as well as the napkins 5 already inserted. As with the example described above, it is possible to use a single material web with a folded base edge 24. By contrast with the example described above, however, not every pocket is filled with a napkin 5. The extra pockets which are not filled are denoted by reference number 30 in FIG. 3 and are wider than the pockets containing a napkin 5. Also in this example, a cut 27 is provided in the top layer in the region of each pocket containing a napkin 5 at a distance from the opening edge 26, the purpose of which will be explained in the description relating to the embodiment illustrated as an example in FIG. 4. The opening edge 26 may be straight as illustrated or contoured as illustrated in FIG. 1.

Figure 4:
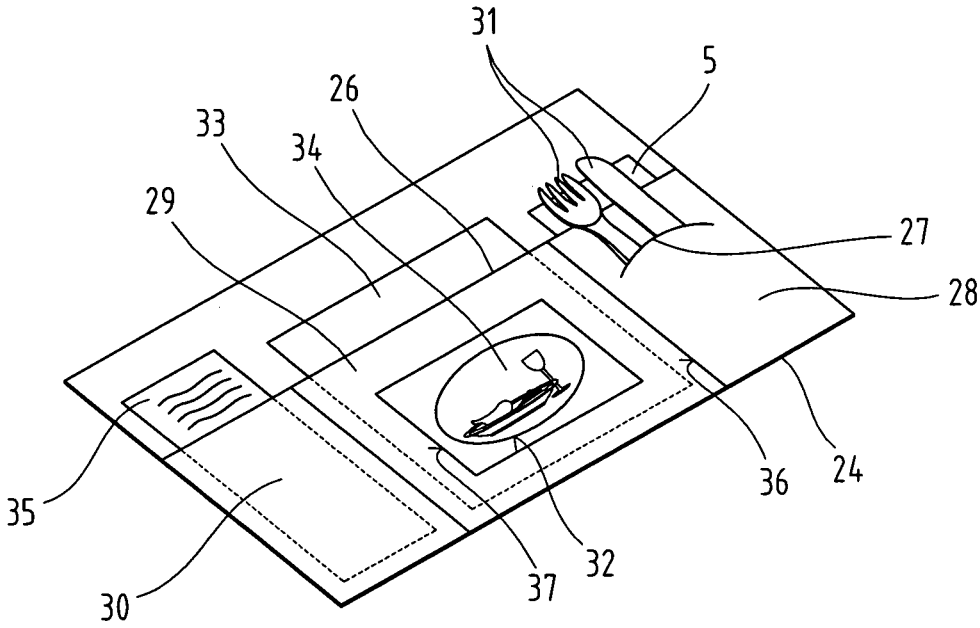
FIG. 4 shows an example of a place setting.

FIG. 4 is a perspective view illustrating an example of a place setting 1. The place setting is described below as if viewed by a person seated at a table, in other words the edge facing this person is the base edge 24 described above in connection with the previous examples. At the right-hand edge 8 of the place setting 1 is a first pocket 28, in which a folded napkin 5 is partially accommodated so that it protrudes upwards by a few centimetres and is therefore visible at first glance. The place setting typically has a width of approximately 40 centimetres and a height of approximately 25 centimetres. The height of the pockets measured from the base edge 24 of the place setting is approximately 18 centimetres, for example. All of these dimensions are given purely by way of example and are not intended to restrict the scope of the invention in any way. The cut 27 mentioned above is provided in the first pocket at a distance from the top edge of the first pocket 28 and, as illustrated in the drawing, may have a curved contour and in which cutlery 31, in particular a fork and a knife, is accommodated. This being the case, both a napkin 5 and cutlery 31 can be accommodated one on top of the other in a space-saving arrangement, even though they are at least visually separated from one another by the top part of the first pocket 28, thereby imparting an attractive appearance overall.

As may also be seen from FIG. 4, a second pocket 29 and a third pocket 30 are disposed at the side next to the first pocket 28. All three pockets 28, 29 and 30 preferably have a common top edge which, as mentioned above, corresponds to the opening edge 26, and extend from it down to the base edge 24 of the place setting. The second pocket 29 has a window 32, through which a part of the object in the pocket 29 is visible, for example an image 34 on a menu 33. If the contents of the pocket 29 need to be protected from dirt, for example, the window 32 may be provided with a transparent film. A drinks menu 35 may be inserted in the third pocket 30 next to the left-hand edge of the place setting. Joining seams 36 and 37 are applied between the pockets 28, 29 and 30, which join the material forming the pockets. In this respect, the joining seems need not extend continuously from the base edge 24 of the place setting to the opening edge 26 of the pockets but may extend over only a part of this distance or be may be interrupted.

The menu 33 and/or the drinks menu 35 as well as the napkin 5 may also be placed in the pockets 29, 30 between the layers 1, 2 during the manufacturing process before joining the layers 1, 2 to form pockets or afterwards in the finished place setting.

For the sake of good order, finally, it should be pointed out that in order to provide a clearer understanding of the design of the device, the pocket and the place setting, they and their constituent parts are illustrated to a certain extent out of scale and/or on an enlarged scale and/or on a reduced scale.

List of Reference Numbers

1 Layer
2 Layer
3 Transport path
4 Spacer
5 Napkin
6 Napkin holder
7 Retaining plate
8 Pressing device
9 Knocking device
10 Ram

11 Double arrow
12 Arm
13 Slot
14 Lateral guide
15 Suction pipe
16 Pivot axis
17 Double arrow
18 Suction orifice
19 Suction orifice
20 Clamping device
21 Pressing roller
22 Seal region
23 Cutting region
24 Base edge
25 Fold
26 Opening edge
27 Cut
28 First pocket
29 Second pocket
30 Third pocket
31 Cutlery
32 Window
33 Menu
34 Image
35 Drinks menu
36 Joining seam
37 Joining seam

The invention claimed is:

1. Method of producing pockets containing a napkin (5), wherein two web-shaped layers (1, 2) of a flat, flexible material are moved along a transport path and held at a distance apart from one another in one section of the transport path, napkins (5) are separated from a stack and placed between the layers (1, 2), regions of the layers (1, 2) adjacent to the napkins (5) are placed in contact with one another and joined to one another downstream of the section in the web direction and the pockets formed in this manner are cut from the web-shaped layers (1, 2), wherein, in the section, a napkin (5) is respectively placed between the layers (1, 2) in a position oriented parallel with the web direction by a movement in the direction at a right angle to the web direction.

2. Method as claimed in claim 1, wherein the two web-shaped layers (1, 2) are formed by folding a single web of the flat, flexible material in the direction of the web.

3. Method as claimed in claim 1, wherein, at the end from which the napkin (5) is placed between the layers (1, 2), the longitudinal edge (26) of the one layer (1) is offset from the longitudinal edge (25) of the other layer (2).

4. Method as claimed in claim 3, wherein the longitudinal edge (25) of the other layer (2) is folded and the folded part extends underneath the longitudinal edge (26) of the one layer (1).

5. Method as claimed in claim 3, wherein the longitudinal edge (26) of the one layer (1) has a contour.

6. Method as claimed in claim 3, wherein cuts (28) are provided in the one layer (1) at a distance from its longitudinal edge (26).

7. Method as claimed in claim 1, wherein the flat, flexible material is a film.

8. Method as claimed in claim 1, wherein the flat, flexible material is paper.

9. Method as claimed in claim 8, wherein at least certain regions of the paper are provided with a sealable coating.

10. Method as claimed in claim 1, wherein the napkins (5) in the stack are oriented parallel with at least one of the two web-shaped layers (1, 2).

11. Method as claimed in claim 1, wherein the napkins (5) in the stack are oriented at a right angle to at least one of the two web-shaped layers (1, 2).

12. Method as claimed in claim 1, wherein the napkins (5) are separated from the stack by means of a displaceable separating element (15) placed under vacuum.

13. Method as claimed in claim 12, wherein the separating element (15) can be pivoted by approximately 90 degrees.

14. Method as claimed in claim 12, wherein a napkin (5) is respectively deposited by the separating element (15) on a ram (10) which moves in a reciprocating motion and places the napkin (5) between the layers (1, 2).

15. Method as claimed in claim 14, wherein a cut-out (13) is provided in the ram (10), through which the separating element (15) moves as it deposits a napkin, and the separating element (15) is placed under a constant vacuum.

16. Method as claimed in claim 1, wherein at least one empty pocket is formed respectively adjacent to a pocket filled with a napkin in the web direction and each group of pockets is cut from the web-shaped layers (1, 2).

17. Device for producing pockets containing a napkin (5), comprising means for transporting two web-shaped layers (1, 2) of a flat, flexible material in the web direction along a transport path, a spacer (4) for holding the layers (1, 2) at a distance apart from one another in a region of the transport path, a napkin holder (6) in which the napkins (5) are stored in a stack, a separating device (15) for separating the napkins (5) from the stack, inserting means (10) for placing a respective napkin (5) between the layers (1, 2), means for placing the layers (1, 2) in contact and joining certain regions of them to form pockets and means for cutting the pockets from the web-shaped layers (1, 2), and the means for placing the layers (1, 2) in contact and joining certain regions of them to form pockets are disposed downstream of the inserting means (10) in the web direction, wherein the inserting means (10) has a support (10) oriented parallel with the web direction and can be moved backwards and forwards in a reciprocating motion in a direction oriented at a right angle to the web direction between a position in which the support is disposed between the layers (1, 2) and a position in which the support (10) is disposed at least partially between the layers (1, 2).

* * * * *